United States Patent [19]

Fruehan

[11] 4,004,920

[45] Jan. 25, 1977

[54] METHOD OF PRODUCING LOW NITROGEN STEEL

[75] Inventor: Richard J. Fruehan, Franklin Township, Westmoreland County, Pa.

[73] Assignee: United States Steel Corporation, Pittsburgh, Pa.

[22] Filed: May 5, 1975

[21] Appl. No.: 574,804

[52] U.S. Cl. ..... 75/60; 75/59

[51] Int. Cl.[2] ..... C21C 5/34

[58] Field of Search ..... 75/59, 60

[56] References Cited

UNITED STATES PATENTS

| | | | |
|---|---|---|---|
| 3,169,058 | 2/1965 | Nelson | 75/60 |
| 3,706,549 | 12/1972 | Knuppel | 75/60 |
| 3,854,932 | 12/1974 | Bishop | 75/60 |

*Primary Examiner*—P. D. Rosenberg
*Attorney, Agent, or Firm*—Arthur J. Greif

[57] ABSTRACT

In bottom blown processes for the production of low carbon steels (i.e. less than 0.2% C), inert gas flushing employed at an intermediate point of the blow, provides more rapid and more efficient removal of $N_2$. Thus, inert gas flushing is initiated at a point when the carbon content of the melt is in excess of 0.3%, and preferably in excess of 0.5%. When $N_2$ is removed to a desired extent, full scale oxygen blowing is resumed to achieve the final degree of decarburization.

6 Claims, 1 Drawing Figure

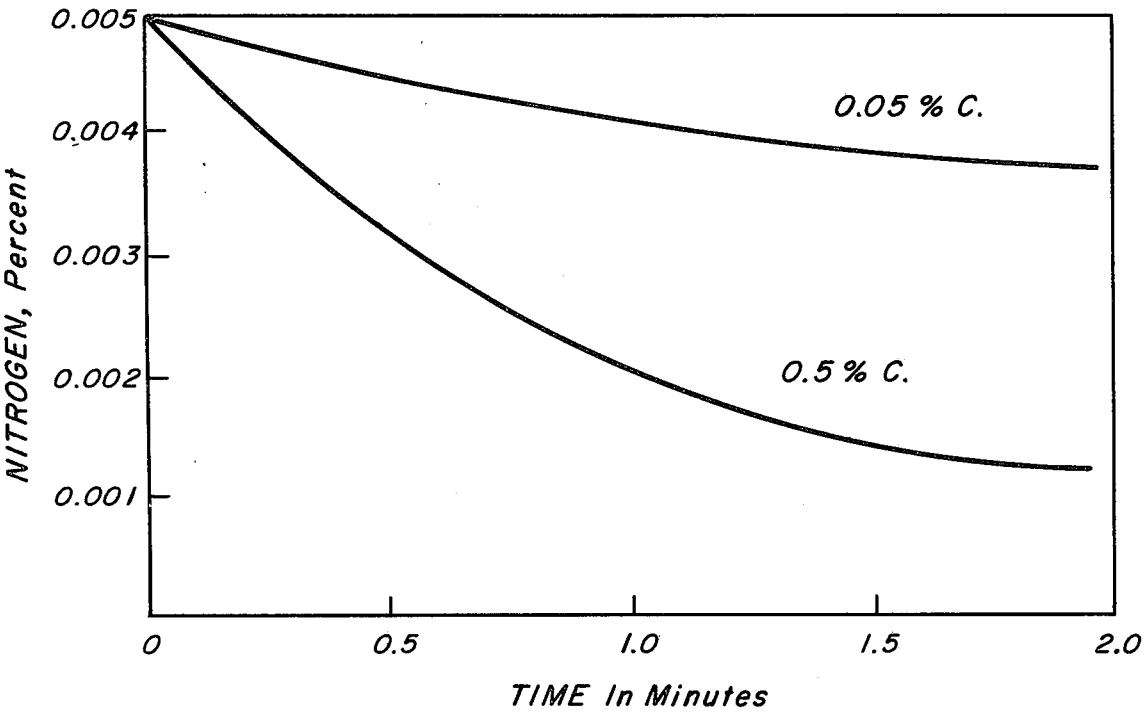
0.005
0.004
0.003
0.002
0.001
NITROGEN, Percent
0.05 % C.
0.5 % C.
0
0.5
1.0
1.5
2.0
TIME In Minutes

METHOD OF PRODUCING LOW NITROGEN STEEL

This invention relates to the refining of pig iron, by any of the bottom-blown pneumatic steelmaking processes, eg. Bessemer, SIP, Q-BOP. More particularly, this invention is directed to a method for achieving more rapid and more efficient removal of $N_2$, when such processes are employed for decreasing the carbon content of a steel melt to a level below 0.2%, and generally below 0.1%.

In the most widely employed pneumatic steelmaking process, the Basic Oxygen Process, oxygen is blown from above, through a lance, so as to pierce through the overlying slag layer and penetrate into the iron melt. When it is desired to remove gaseous impurities, such as nitrogen, from a BOP refined steel melt; the steel is teemed from the BOP furnace into a ladle and inert gas flushing is employed for periods ranging from about 10 to 25 minutes. By contrast therewith, in the above noted bottom-blown processes, the oxygen is blown from a point below the top surface of the melt, through tuyeres located in the bottom or in he sides of the converter. With respect to SIP or Q-BOP, a protective gas, generally a hydrocarbon, is employed to encase or surround the oxygen stream in order to decrease the inordinately high wear which would occur at the tuyeres and the converter entry area (i.e. the bottom in the Q-BOP). One of the significant advantages of the bottom-blown processes over the BOP, is their adaptability in permitting inert-gas purging to be carried out in the steelmaking vessel itself. Additionally, the Q-BOP in particular, provides more effective and efficient degassing in a shorter period of time, as a result of the comparatively higher gas-flow rates which may be employed. With respect to the efficiency of such purging, a theoretical minimum amount of inert gas (generally argon) is, of course, required for the removal of a desired amount of $N_2$ (see, for example, Kollman and Preusch, *Proceedings of the Electric Furnace Conference of AIME*, 1961, pp. 23–42). However, in actual practice many times more argon is found to be required, because many of the reactions involved are controlled by mass transfer in the liquid phase and do not go to completion in a practical time period.

In view thereof, it is a principal object of this invention to provide a purging procedure, in which both the amount of inert gas employed and the time required for effecting the removal of a desired degree of $N_2$, may significantly be decreased.

Other objects and advantages of this invention will become more apparent from the following description when read in conjunction with the appended claims and the drawing, in which The FIGURE is a graph illustrating the marked difference in nitrogen removal rate between two steels of differing carbon contents.

Gaseous impurities, such as $N_2$, are normally removed by purging the steel with argon; such removal being effected by the lowering of the $N_2$ partial pressure as a result of the diluting effect of the argon. As noted above, such purging is conventionally accomplished only after the steel melt has been decarburized to the desired extent. It has now been found that the rate of nitrogen removal, at high oxygen activities (for example, 500 or even 300 ppm oxygen) is controlled by a slow chemical reaction on the surface of the molten iron. Thus, at such high oxygen activities, the iron surface is essentially covered by a layer of adsorbed oxygen which seriously retards the rate of $N_2$ removal. It has also been determined that the relative importance of this retardation effect decreases with oxygen activity, so that at low oxygen activities (for example less than 100 ppm oxygen) the overall rate of $N_2$ is controlled either by liquid phase mass transfer or by the saturation of the inert gas to the equilibrium $N_2$ pressure. In the latter instance (low oxygen activity) liquid phase mass transfer is the dominant control at relatively high nitrogen levels (of the order of 0.01% $N_2$); while saturation control prevails at very low nitrogen levels (<0.002% $N_2$). In view of these findings as to the retardation effect of adsorbed oxygen, it may readily be understood why the oxygen blow itself, is not very efficient in effecting the removal of $N_2$ from the steel melt.

Since oxygen activity is inversely proportional to carbon activity, it may be seen that the efficiency of inert gas purging may significantly be enhanced by effecting such purging at comparatively high carbon contents, i.e. in excess of 0.3%, and more preferably in excess of 0.5% carbon. The significant benefits resulting from purging at such higher carbon levels is illustrated by the two curves of the figure. For example, an argon flush of 2000 $ft^3$/min, performed for two minutes in a 30-ton heat (which had previously been decarburized to a carbon content of 0.05%) was only capable of reducing the initial 0.005% nitrogen content to about 0.004%. By contrast, when the same flushing rate was performed on a comparably sized heat prior to the time the carbon content thereof was reduced to 0.5%, the nitrogen content was reduced to nearly 0.001% for the same two-minute flush.

While it should be understood that the invention is applicable to all bottom-blown steelmaking processes, the procedure for carrying out the teachings thereof will be described in its specific applicability to the Q-BOP process. Initial blowing of the pig iron is performed as in conventional Q-BOP practice. That is, a stream of generally commercially pure oxygen is introduced into the melt through tuyeres located in or near the converter bottom. The use of oxygen of such purity, would normally result in extremely rapid wear of both the tuyeres and the bottom itself. Therefore, each oxygen stream is surrounded by an encasing or coolant gas to slow down the violent reaction and thereby achieve substantially reduced wear. The ratio of oxygen to encasing gas is desirably held within a critical range so as to permit such wear to proceed in a slow and controlled manner. Thus, during this initial blowing period there are basically two different gas throughput rates which are of concern; Ro the rate at which $O_2$ is introduced, and Rp the rate at which protective gases (eg. methane) are introduced. As shown in U.S. Pat. No. 3,706,549, the disclosure of which is incorporated herein by reference, Ro>>Rp. In view thereof, the average total rate RT may be defined as the sum of Ro + Rs, wherein Rs is the rate of introduction of all other gases. For example, Rs may equal Rp plus RA, wherein RA is the rate of introduction of argon or other inert gas. It should be noted that RT is not necessarily constant, but merely the average total rate of gas introduction. It is necessary, however, that RT be maintained within a requisite throughput range of from about 75 NCF/min per ton of steel to about 160 NCF/min per ton of steel being refined. The minimum rate is dictated by the need to maintain sufficient back pressure in the tuyeres, in order to prevent molten metal from plugging the tuyere openings. While rates higher than the above noted maximum would be desirable for shortening the length of the blow (thereby increasing production capability), it has been found that rates significantly higher than 160 NCF/min per ton result in undesirable splashing and spitting above the converter.

For the initial portion of the blow, RA will generally be zero or negligible, while Ro will be greater than 0.8 RT. Thereafter, for a steel containing an initial level of nitrogen in excess of that desired in the final steel product (i.e. ≥ 0.002% N, and generally ≥ 0.004% N) the melt will be purged with an inert gas (eg. argon) for a time sufficient to decrease the nitrogen content to the desired level which generally will be less than 80%, and often less than 50% of said initial level. Although purging may be initiated at any time before the carbon content of the melt has been reduced to 0.3%, it is preferable that such purging not be initiated until (i) after the silicon portion of the blow (so as to insure the achievement of desirable temperature), but (ii) before the melt has been decarburized to less than 0.5% carbon (to insure desirably low oxygen activity). Purging is preferably conducted by terminating the oxygen blow and substituting an inert gas therefor; that is $R_o$ will be reduced to zero, while $R_A \approx R_T$. Although less desirable, it is not essential, however, that $R_o$ be reduced to zero. Thus, the inert gas may contain a small amount of oxygen, since such oxygen will rapidly be converted to CO; resulting in an effective gas retention time in the bath in which the activity of oxygen will nevertheless be sufficiently low for the purpose hereof. Therefore, purging within the scope contemplated by this invention may be conducted wherein the purge gas rate $R_A$ is at least 0.8 $R_T$. As noted above, purging is conducted for a time sufficient to decrease the nitrogen content of the bath to the desired level. Depending both on the amount of nitrogen to be removed and the magnitude of $R_A$, times varying from about ½ to 2 minutes will ordinarily be sufficient. Subsequently, decarburization is then resumed by increasing the rate of oxygen introduction so that $R_o$ is again at least 0.8 $R_T$; this resumed oxygen blow continuing until bath carbon content is reduced to the desired final level, generally less than 0.1% carbon.

I claim:

1. In a bottom blown process for the refining of molten pig iron wherein a stream of oxygen-containing gas is introduced so as to decrease the carbon content in the resulting refined molten steel to a level below 0.2 percent, said gas being introduced at a total rate $R_T$ within the requisite throughput range, wherein $R_T$ is the sum of $R_O$, the rate at which oxygen is introduced and $R_s$, the rate at which other gases are introduced, and wherein $R_O$ is at least $0.8R_T$, said bath containing an initial level of nitrogen in excess of 0.002%, said initial level being substantially in excess of that desired in the final steel product, the improvement which comprises, a. introducing an inert gas prior to the time the carbon content of the molten bath is decreased to a level of 0.3 percent, so as to achieve a purging rate of inert gas introduction which is at least 0.8 $R_T$, said inert gas being introduced at said purging rate for a time sufficient to decrease the nitrogen content to a desired level which is less than 80 percent of said initial level;

b. thereafter, increasing the rate of oxygen introduction so that $R_o$ is again at least 0.8 $R_T$, said increased rate of oxygen introduction being employed for a time sufficient to decrease the bath carbon content to a final level below 0.2%.

2. The method of claim 1, wherein said inert gas is introduced at said purging rate prior to the time the carbon content of the molten bath is decreased to a level of 0.5 percent.

3. The method of claim 2, wherein said inert gas is introduced at said purging rate for a time sufficient to decrease the nitrogen content to a level which is less than 50 percent of said initial level.

4. The method of claim 3, wherein the bath is decarburized to a final carbon level below 0.1%.

5. The method of claim 4, wherein said initial nitrogen level is equal to or greater than 0.004 percent.

6. The method of claim 5, wherein said purging rate is approximately equal to $R_T$.

* * * * *